United States Patent [19]

Layher

[11] 4,394,095

[45] Jul. 19, 1983

[54] SCAFFOLDING STRUCTURE

[76] Inventor: Eberhard Layher, Blankenhornstrasse 17, D-7129 Güglingen-Eisensbach, Fed. Rep. of Germany

[21] Appl. No.: 328,100

[22] Filed: Dec. 7, 1981

[30] Foreign Application Priority Data

Apr. 29, 1981 [DE] Fed. Rep. of Germany ... 8112653[U]

[51] Int. Cl.[3] ..... E04G 7/00

[52] U.S. Cl. ..... 403/49

[58] Field of Search ..... 403/49

[56] References Cited

U.S. PATENT DOCUMENTS 4,083,640 4/1978 Lovering ..... 403/49

4,095,910 6/1978 Steele et al. ..... 403/49

FOREIGN PATENT DOCUMENTS 2822676 11/1979 Fed. Rep. of Germany .

*Primary Examiner*—Andrew V. Kundrat

*Attorney, Agent, or Firm*—Michael J. Striker

[57] ABSTRACT

A horizontal or diagonal bracing element in a scaffolding structure includes a terminal lug which is pivotably connected to another lug on a connection shoe; the shoe is provided with an elongated slot for receiving a fastening wedge insertable into a radial aperture in a connection flange on a vertical supporting element of the scaffolding; the other lug forms with the midline of the elongated slot an angle of 135°.

3 Claims, 2 Drawing Figures

SCAFFOLDING STRUCTURE

BACKGROUND OF THE INVENTION

The present invention relates in general to scaffolding structures, and in particular to a structural element for use in scaffolding systems which include vertical supporting elements with annular flanges for engaging bifurcated shoes of horizontally or diagonally directed scaffolding elements, the shoes and the flanges being formed with radially directed apertures or slots for receiving fastening wedges.

In known scaffolding systems of this kind the connection flange is designed such that the radial openings have different shapes including two opposite pairs of oblong oval cutouts the radial midlines of which intersect at the center axis of the vertical supporting element; in the areas between the oval cutouts are formed border cutouts the clearance of which forms relative to the central axis of the element and angle of about 40°. Horizontal and diagonal scaffolding elements are fastened to the vertical elements in such a manner that the prong of the bifrucated connection shoes embrace from opposite sides the disc-shaped connection flanges of the vertical elements and thereupon fastening wedges are inserted into the aligned apertures in the shoe and in the flange.

Hitherto it was necessary to employ diagonal braces which must be connected by wedges to the cutouts between the oval cutouts; such diagonal pieces are needed for example when constructing working platforms in large empty spaces in the interior of buildings for working on ceilings. In this case, all four elongated oval cutouts in respective connection flanges are already occupied by the horizontal scaffolding elements so that these oval cutouts arranged at right angles relative to each other cannot be used for fastening the diagonal braces. In the German published patent application No. 28 22 676, it has been already devised to use for this purpose shoe piece formed with a rectangular prism between the connection shoe and a lug provided for the attachment of this shoe at the end of the diagonal scaffolding element. In this known manner it is possible to attach the diagonal braces to one of the broad cutouts between the narrower oval cutouts. This prior art solution, however, is disadvantageous inasmuch the provision of a prismatic intermediate shoe piece causes a relatively large spacing between the plane extending through the connecting point of the lug parallel to the diagonal brace and the center axis of the vertical scaffolding element; consequently an undesired and excessive torque or rotary moment is produced.

SUMMARY OF THE INVENTION

It is therefore a general object of the present invention to overcome the aforementioned disadvantages.

More particularly, it is an object of the invention to provide an improved scaffolding system which is not possessed of these disadvantages.

An additional object of the invention is to provide a scaffolding structure, particularly for diagonal bracing which avoids the aforementioned unfavorable rotary moment.

In keeping with these objects, and others which will become apparent hereafter, one feature of the invention resides, in a scaffolding system of the aforedescribed type, in the provision of a conventional bifurcated connection shoe which is engageable with both sides of the connecting flange on the vertical supporting element and being provided with an elongated slot for receiving the fastening wedge, a lug integrally connected to the shoe and projecting at an angle of about 135° relative to the midline of the elongated slot, another lug formed at an end of a scaffolding element and being pivotably connected to the lug of the shoe.

The other end of the structural element can be connected to another vertical supporting element of the scaffolding system by means of a double coupling. Naturally, there is always a possibility to select the length of this diagonal scaffolding element such that according to standard sizes of the scaffolding system in question it can be connected at its both ends to the connection flanges of two adjacent vertical supporting elements. In this case it is of advantage when the scaffolding element is provided at both ends thereof with a corresponding pivotably mounted connection shoes according to this invention.

If the scaffolding element applicable as a diagonal strap or brace in the scaffolding system is in the form of a pipe then the terminal lug serving for the pivotable support of the connection shoe is made preferably by compressing the end portion of the tubular element whereupon the other lug on the connection shoe is hinged to the flattened terminal lug.

By virtue of the arrangement according to this invention the point of action of the force transmitted by the diagonal brace lies on substantially shorter lever arm than in prior art solutions using the intermediate prismatic pieces. Consequently, the mechanical and kinematic conditions resulting from the invention are substantially superior to those of prior art. An additional advantage is to be seen in the fact that by means of the diagonal scaffolding elements of this invention, considerable savings on labor, material and weight are obtained.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
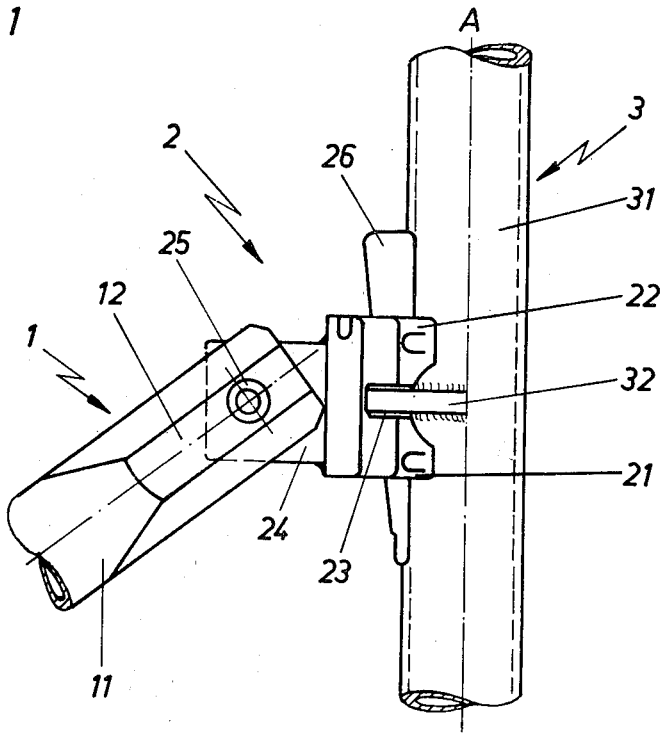
FIG. 1 is a side view of a cut-away portion of a diagonal brace including the connection shoe according to this invention.
Figure 2:
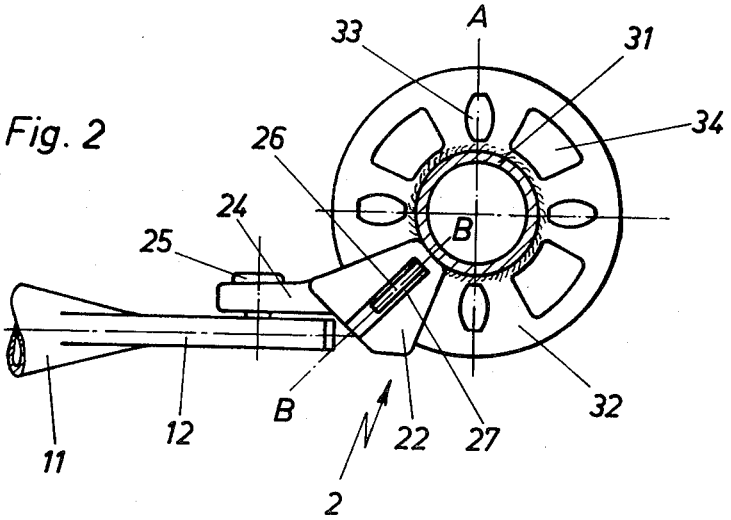
FIG. 2 is a top view of the shoe arrangement of FIG. 1.

In the drawings, reference numeral 1 denotes a scaffolding element for use as a diagonal strap or brace in a scaffolding system; reference numeral 2 indicates a connection shoe to a vertical supporting element 3, the latter being constituted by a tube 31 and a connection flange 32 rigidly connected to the pipe 31 by welding, for example. The connection flange 32 is in the form of an annular plate in which four oval cutouts 33 are provided in such a manner that the long axes of the oval cutouts intersect at right angles the central axis A of the scaffolding vertical pipe 31. Additional broad cutouts 34 are provided between adjacent oval cutouts 33.

The scaffolding element 1 designed for a diagonal installation consists in this embodiment of a pipe 11 the end portion of which is formed into a lug 12 produced preferably by compressing this end portion.

The connection shoe 2 is pivotably connected to this lug 12 by a bolt 25. The bifurcated shoe 2 defines a lower jaw 21 and an upper jaw 22 with an open slot 23 therebetween the clearance of which is diminishing such as to fit the thickness of flange 32 with a tolerance permitting free insertion of the shoe.

Both jaws 21 and 22 are provided with elongated slots 27 which are in vertical register with each other. The length of the aligned slots is adjusted to the radial length of the broad cutouts 34 so that upon insertion of the connection shoe 2 on the flange 32 the end of the shoe abuts against the vertical pipe 31 and by driving a fastening wedge 26 through the elongated slot 27 and through the broad cutout 34 in the flange, the shoe is firmly connected to the vertical scaffolding element 3. The broader end of the shoe overhanging the connection flange 32 is rigidly connected to a lug 24 which is hinged to the lug 12 of pipe 11 by the bolt 25 and which forms with the middleline B-B of the elongated slot 27 an angle of 135°. Upon joining the shoe to the flange 32, the middline B-B intersects the center of the vertical scaffolding element 3.

It will be understood that each of the elements described above, or two or more together, may also find a useful application in other types of constructions differing from the types described above.

While the invention has been illustrated and described as embodied in a scaffolding element for a horizontal or diagonal installation in a scaffolding system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A scaffolding structure for use in scaffolding systems which include vertical supporting elements provided with annular flanges having radially directed apertures for receiving fastening wedges, said scaffolding structure comprising a scaffolding element formed at one end thereof with a terminal lug; a coupling shoe having two prongs arranged one above the other; an open slot formed between the prongs for engaging the flange and an elongated slot formed in the prongs for receiving the fastening wedge, another flat lug projecting outwardly from the terminal end of said shoe at an angle of about 135° relative to the elongated slot, said flat lug having its sides extending parallel to said terminal lug and being pivotably connected thereto.

2. A scaffolding structure as defined in claim 1, wherein a terminal lug with a pivotably connected shoe, is provided at each end of the element.

3. A scaffolding structure as defined in claim 1 wherein said scaffolding element is formed of a hollow tubular member and wherein said terminal lug is formed by compressing the end portion of the tubular member.

* * * * *